US005711654A

United States Patent [19]

Afflerbaugh

[11] Patent Number: 5,711,654

[45] Date of Patent: Jan. 27, 1998

[54] PERISTALTIC PUMP WITH ROTOR POSITION SENSING EMPLOYING A REFLECTIVE OBJECT SENSOR

[75] Inventor: Richard L. Afflerbaugh, Libertyville, Ill.

[73] Assignee: Baxter International Inc., Deerfield, Ill.

[21] Appl. No.: 472,548

[22] Filed: Jun. 7, 1995

[51] Int. Cl.[6] ..... F04B 43/12

[52] U.S. Cl. ..... 417/63; 417/42; 417/476; 417/474; 417/477.2

[58] Field of Search ..... 417/42, 63, 474–479

[56] References Cited

U.S. PATENT DOCUMENTS

| | | | |
|---|---|---|---|
| 3,565,286 | 2/1971 | Latham, Jr. . | |
| 4,025,241 | 5/1977 | Clemens | 417/477 |
| 4,447,191 | 5/1984 | Bilstad et al. | 417/63 |
| 4,537,561 | 8/1985 | Xanthopoulos . | |
| 4,623,328 | 11/1986 | Hartranft | 604/4 |
| 4,681,568 | 7/1987 | Troutner . | |
| 4,692,138 | 9/1987 | Troutner et al. . | |
| 4,705,464 | 11/1987 | Arimond . | |
| 4,861,242 | 8/1989 | Finsterwald . | |
| 4,869,646 | 9/1989 | Gordon et al. | 417/63 |
| 4,919,596 | 4/1990 | Slate et al. | 417/479 |
| 4,976,593 | 12/1990 | Miyamoto | 417/474 |
| 5,094,820 | 3/1992 | Maxwell et al. . | |
| 5,188,588 | 2/1993 | Schoendorfer et al. . | |
| 5,263,831 | 11/1993 | Kappus . | |
| 5,427,509 | 6/1995 | Chapman et al. . | |
| 5,531,680 | 7/1996 | Dumas et al. | 417/474 |
| 5,549,458 | 8/1996 | Chapman et al. | 417/477.8 |
| 5,551,850 | 9/1996 | Williamson et al. | 417/474 |
| 5,567,120 | 10/1996 | Hungerford et al. | 417/474 |

*Primary Examiner*—Timothy Thorpe
*Assistant Examiner*—Ted Kim
*Attorney, Agent, or Firm*—Daniel D. Ryan; Denise M. Serewicz; Bradford R. L. Price

[57] ABSTRACT

The position of a rotating pump element is sensed by a reflective object sensor 406 in association with a view disk 412 coupled to the operative element for rotation in synchrony with the operative element. The view disk 412 has first 422 and second 420 surface portions that present themselves in succession to the reflective object sensor during rotation of the operative element. The first surface portion 422 is spaced at or near the optical focus of the reflective object sensor, whereas the second surface portion 422 is not. The reflective object sensor 406 thus generates different outputs, depending upon whether the first surface or second surface portions are in optical alignment with the reflective object sensor.

6 Claims, 14 Drawing Sheets

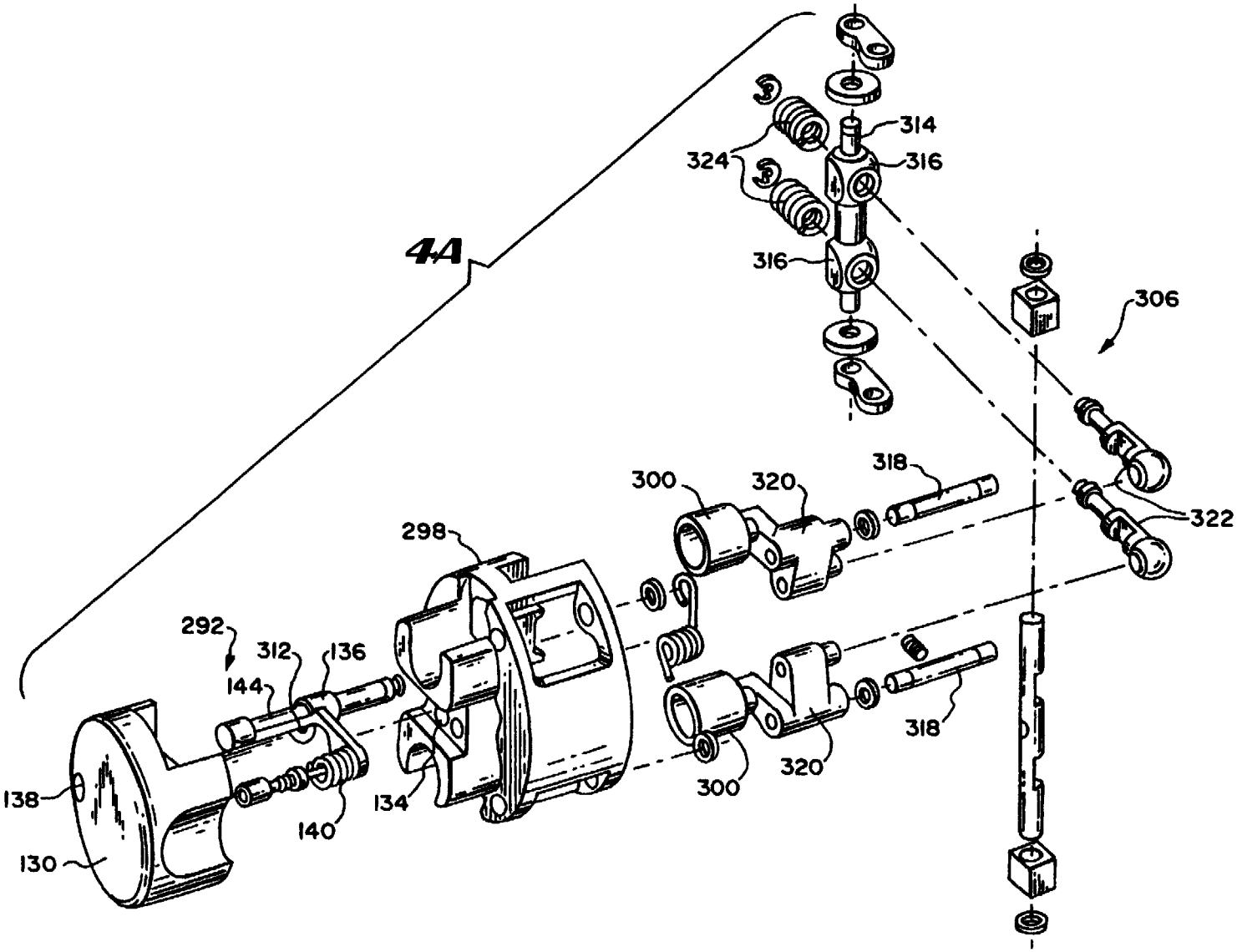
306
322
314
316
318
318
320
320
324
316
300
300
44
298
134
136
140
312
144
292
138
130

PERISTALTIC PUMP WITH ROTOR POSITION SENSING EMPLOYING A REFLECTIVE OBJECT SENSOR

FIELD OF THE INVENTION

The invention relates to blood processing systems and apparatus.

BACKGROUND OF THE INVENTION

Today people routinely separate whole blood by centrifugation into its various therapeutic components, such as red blood cells, platelets, and plasma.

Conventional blood processing methods use durable centrifuge equipment in association with single use, sterile processing systems, typically made of plastic. The operator loads the disposable systems upon the centrifuge before processing and removes them afterwards.

Conventional centrifuges often do not permit easy access to the areas where the disposable systems reside during use. As a result, loading and unloading operations can be time consuming and tedious.

Disposable systems are often preformed into desired shapes to simplify the loading and unloading process. However, this approach is often counter-productive, as it increases the cost of the disposables.

SUMMARY OF THE INVENTION

The invention provides a pump mechanism having an operative element rotatable about a rotational axis in a range of rotational positions. According to the invention, the pump mechanism has an on board sensing element that determines when the operative element of the pump is oriented in a particular rotational position within the range of positions.

More particularly, the pump mechanism includes a reflective object sensor that transmits energy along a first optical axis and senses reflected energy along a second optical axis. The first and second axes converge at a point, called a focus point, which can also be considered the point of optimal response. The reflective object sensor generates an output, which varies according to magnitude of the reflected energy.

The pump mechanism also includes a view disk associated with the reflective object sensor. The view disk is concentric with the rotational axis and is coupled to the operative element for rotation in synchrony with the operative element through the range of rotational positions. The view disk is spaced in optical alignment with the reflective object sensor. The view disk has first and second surface portions which present themselves in succession to the reflective object sensor as the operative element rotates.

The first surface portion presents itself to the reflective object sensor at or near the optical focus. The first surface portion is made of a material that reflects the energy transmitted by the reflective object sensor. Energy transmitted by the sensor thus readily reflects back off the first surface portion to the sensor. This creates a first output.

The second surface portion presents itself to the reflective object sensor at a second distance, different from the first distance, and thus spaced from the optical focus. Energy transmitted by the sensor is thus not so readily reflected back by the first surface portion as the first surface portion. A second output, different than the first output, results.

According to the invention, the reflective object sensor generates, during rotation of the operative element through the range of rotational position, the first output while the first portion is in optical alignment with the reflective object sensor and the different second output while the second portion is in optical alignment with the reflective object sensor. The quantitative difference in outputs quickly differentiates between rotational positions of the operative element.

In a preferred embodiment, the first surface portion has a first circumferential distance measured about the rotational axis that is less than the second circumferential distance measured about the rotational axis. The pump mechanism is thereby able to accurately differentiate specific rotational positions within a relatively few degrees of rotation.

In one embodiment, the pumping mechanism further includes a control element coupled to the reflective object sensor for controlling rotation of the operative element based, at least in part, upon the first and second outputs. In a preferred embodiment, the control element terminates rotation of the operative element upon receiving the first output.

In a preferred embodiment, the operative element is a peristaltic pump rotor. The rotor includes a particular rotational position best suited for loading pump tubing on the rotor. In this embodiment, the pump mechanism presents a first surface portion of relatively small circumferential length to the reflective object sensor, only when the pump rotor occupies the particular pump tube loading position. The resulting first output generates a command signal that stops rotation of the rotor, so that pump tube loading can proceed.

The juxtaposition of a reflective object sensor and two circumferentially spaced surfaces, one lying near the optical focus and the other not, provides a reliable, straightforward mechanism for sensing and controlling pump position.

The features and advantages of the invention will become apparent from the following description, the drawings, and the claims.

BRIEF DESCRIPTION OF THE DRAWINGS

FIG. 4A is an exploded view of the rotor assembly of the pump shown in FIG. 1A;

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1A:
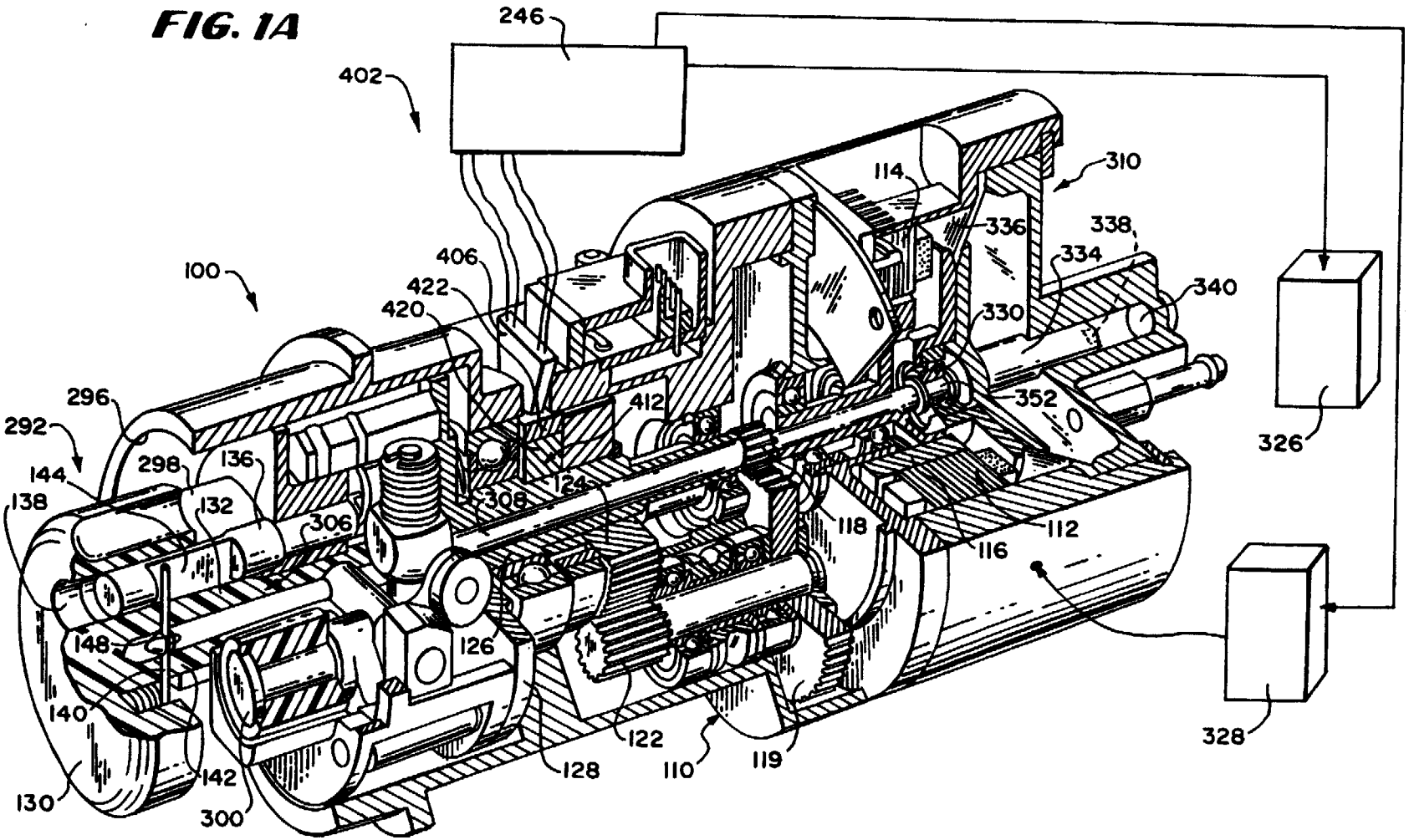
FIG. 1A is a perspective view of a peristaltic pump that embodies the features of the invention, with interior portions broken away and in section.

FIG. 1A shows a peristaltic pump 100 that embodies the features of the invention.

The pump 100 includes a drive train assembly 110, which is mechanically coupled to a rotor assembly 292.

The pump 100 can be used for processing various fluids. The pump 100 is particularly well suited for processing whole blood and other suspensions of biological cellular materials.

The drive train assembly 110 includes a motor 112. Various types of motors can be used. In the illustrated and preferred embodiment, the motor 112 is a brushless D.C. motor having a stator 114 and a rotor 116.

The drive train assembly 110 further includes a pinion gear 118 attached to the rotor 116 of the motor 112. The pinion gear 118 drives gear 119 connected to pinion gear 122, which, in turn, mates with torque gear 124. The torque gear 124 and rotor pinion gear 118 are aligned along a common rotational axis. As will be explained in greater detail later, this allows the passage of a concentric actuating rod 308 along the rotational axis.

Figure 1B:
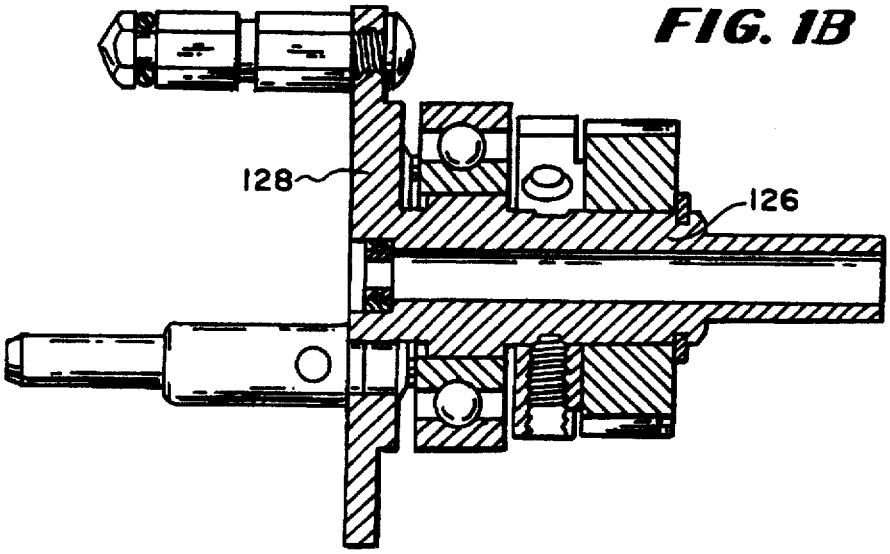
FIG. 1B is a side section view of the carrier associated with the pump shown in FIG. 1A.

The torque gear 124 is attached to a carrier shaft 126, the distal end of which includes a carrier 128 (see FIG. 1B also) for the rotor assembly 292.

The rotor assembly 292 includes a rotor 298 that rotates about the rotational axis. The rotor assembly 292 carries a pair of diametrically spaced rollers 300 (see FIGS. 2 and 3). In use, as FIG. 3 best shows, the rollers 300 engage flexible tubing 120 against an associated pump race 296. Rotation of the rotor 298 causes the rollers 300 to press against and urge fluid through the tubing 120. This peristaltic pumping action is well known.

Figure 2:
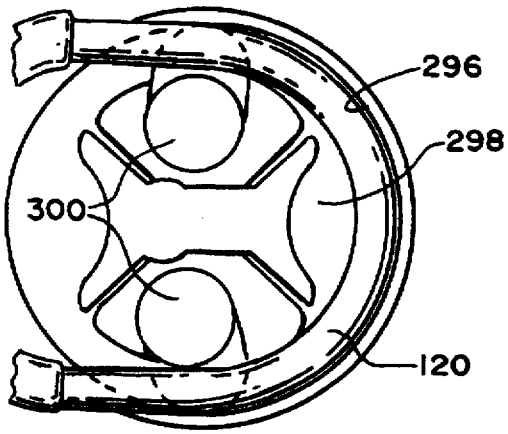
FIG. 2 is a top view of the rotor assembly of the pump shown in FIG. 1A, with tubing located in the pump race, and the pump rollers in a retracted position.
Figure 3:
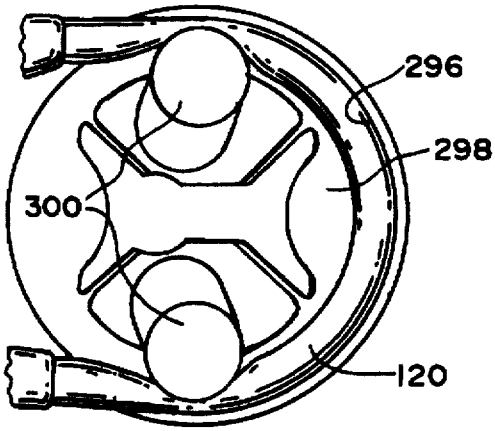
FIG. 3 is a top view of the rotor assembly of the pump shown in FIG. 1A, with tubing located in the pump race, and the pump rollers in an extended position in contact with the tubing.
Figure 4B:
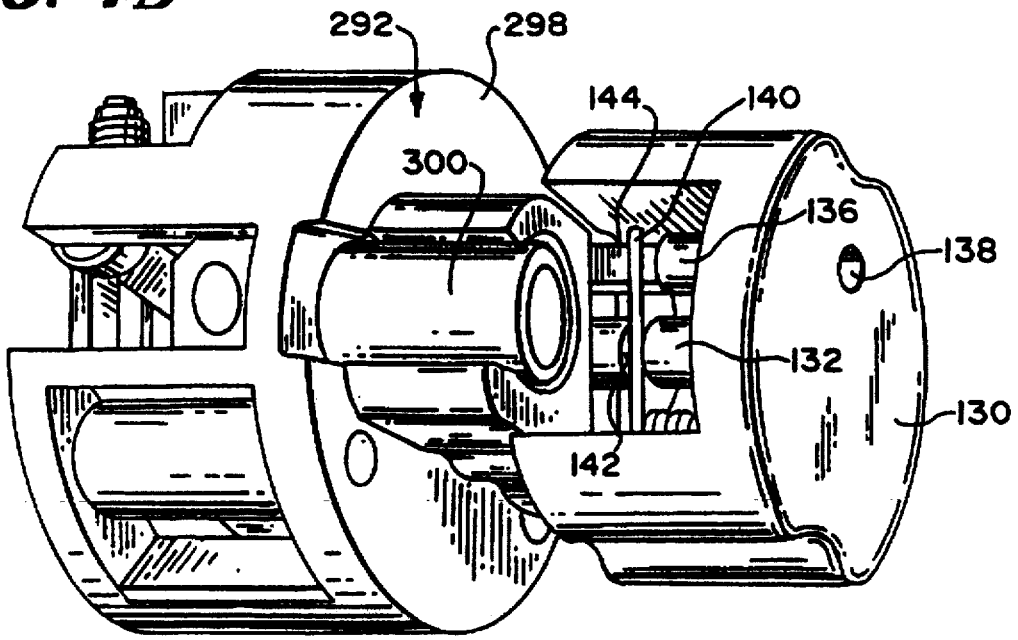
FIG. 4B is a perspective side view of the rotor assembly shown in FIG. 4A, with the pump rollers in a retracted position.
Figure 5:
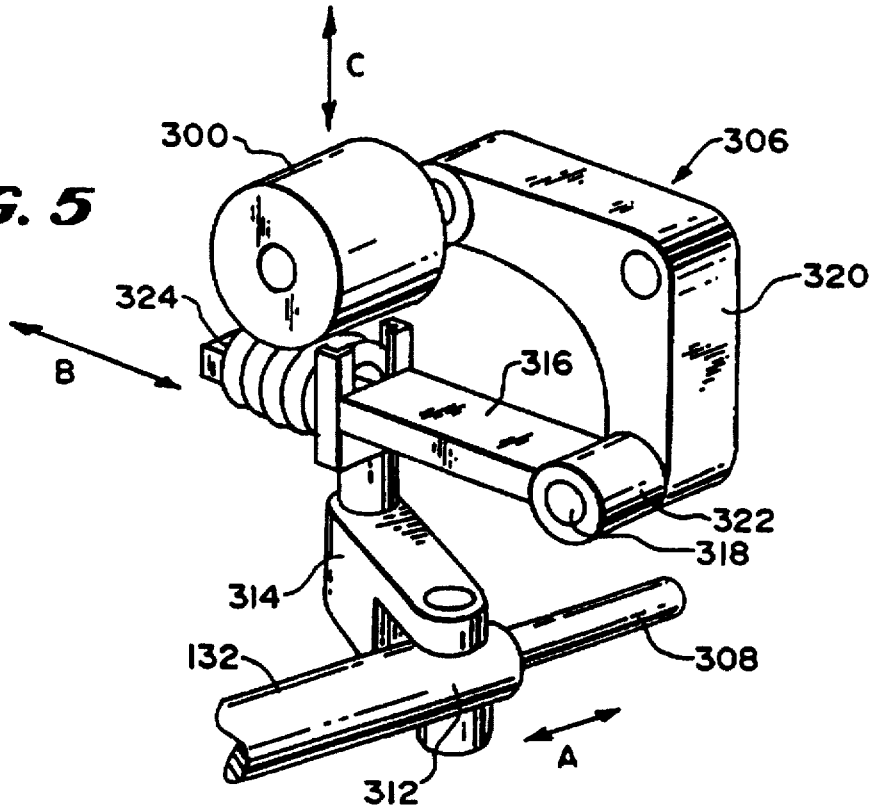
FIG. 5 is a perspective, somewhat simplified view of the mechanism for retracting and extending the pump rollers in the rotor assembly shown in FIG. 4A.

The rotor assembly 292 also includes a roller locating assembly 306 (as best shown in FIGS. 4A and 5). The locating assembly 306 moves the pump rollers 300 radially inward or outward of the axis of rotation. The rollers 300 move between a retracted position within the associated pump rotor 298 (as FIG. 2 shows) and an extended position outside the associated pump rotor 298 (as FIG. 3 shows).

When retracted (see FIG. 2), the rollers 300 make no contact with the tubing 120 within the race 296 as the rotor 298 rotates. When extended (see FIG. 3), the rollers 300 contact the tubing 120 within the race 296 to pump fluid in the manner just described.

The roller locating assembly 306 may be variously constructed. In the illustrated and preferred embodiment (see FIGS. 4A and 4B), the assembly 306 includes an external gripping handle 130 that extends from the rotor 298. As FIGS. 4A and B show, the gripping handle 130 includes a center shaft 132 that fits within a bore 134 in the rotor 298. The bore 134 is aligned with the rotational axis of the assembly 292.

Figure 6:
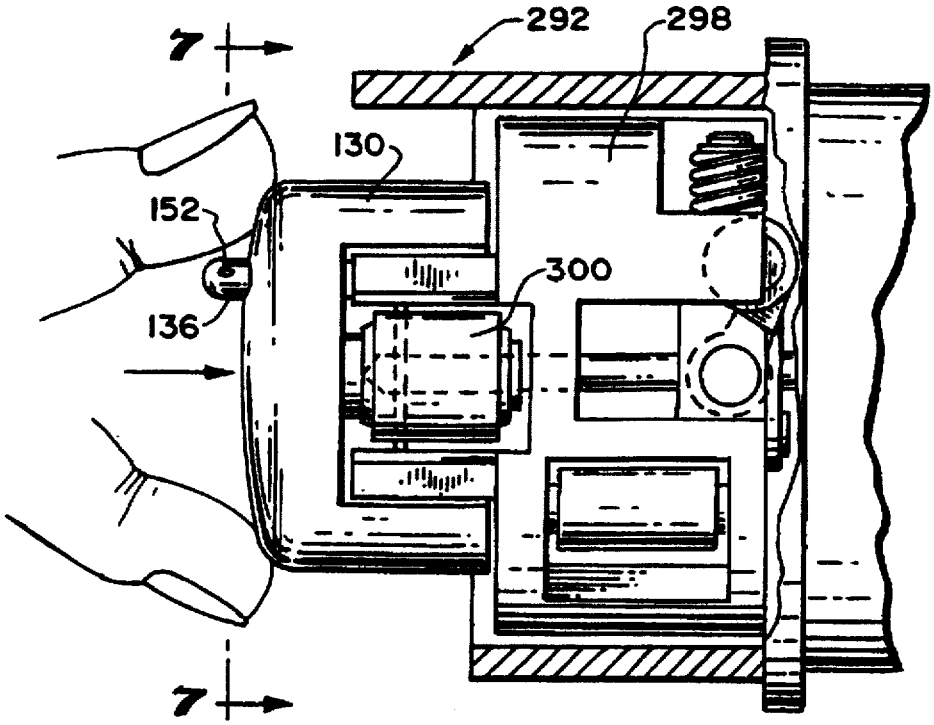
FIG. 6 is a side view of the rotor assembly shown in FIG. 4A, with the pump rollers in an extended position.
Figure 8:
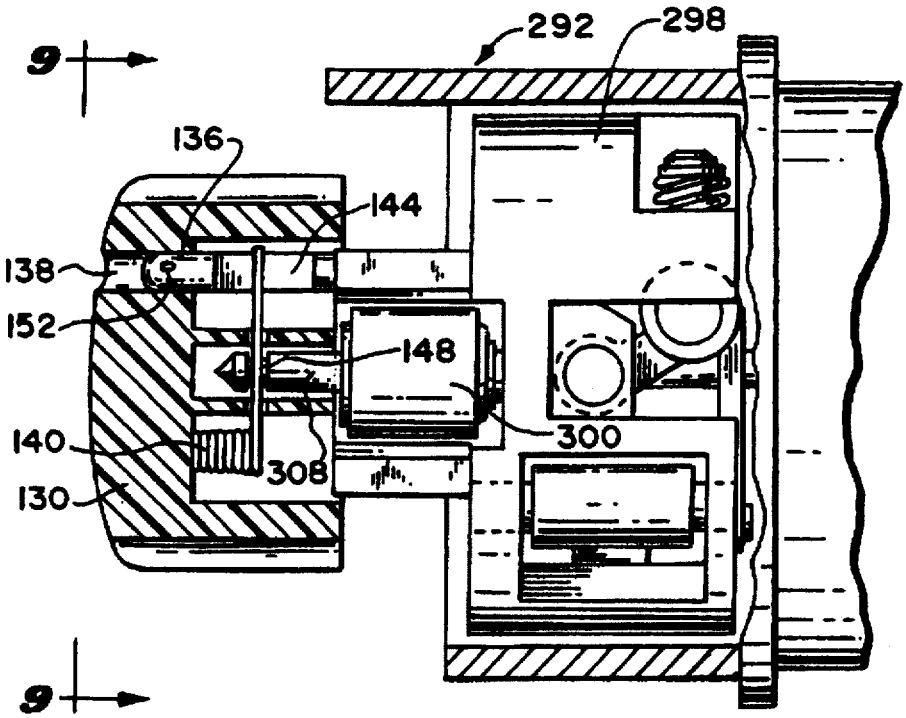
FIG. 8 is a side view of the rotor assembly shown in FIG. 4A, with the pump rollers in a retracted position.

A release bar 136 secured to the rotor 298 correspondingly sits within an off-center bore 138 in the handle 130. As FIG. 4B shows, a release spring 140 seated within the handle fits within a groove 142 in the handle shaft 132 and rests against a relieved surface 144 on the release bar 136 to attach the handle 130 to the rotor 298. Mutually supported by the shaft 132 and the release bar 136, and secured by the spanning release spring 140, the handle 130 rotates in common with the rotor 298. As FIGS. 6 and 8 show, the handle 130 slides inward and outward with respect to the rotor 298.

As FIG. 5 best shows, the end of the handle shaft 132 includes a first trunnion 312 within the rotor 298, which moves as the handle 130 slides along the axis of rotation (shown by the arrows A in FIG. 5). As FIGS. 4A and 5 show, a first link 314 couples the first trunnion 312 to a pair of second trunnions 316, one associated with each roller 300. In FIG. 5, only one of the second trunnions 316 is shown for the sake of illustration. The first link 314 displaces the second trunnions 316 in tandem in a direction generally transverse to the path along which the first trunnion 312 moves (as shown by arrows B in FIG. 5). The second trunnions 316 thereby move in a path that is perpendicular to the axis of rotor rotation (that is, arrows B are generally orthogonal to arrows A in FIG. 5).

As FIGS. 4A and 5 also show, each pump roller 300 is carried by an axle 318 on a rocker arm 320. The rocker arms 320 are each, in turn, coupled by a second link 322 to the associated second trunnion 316.

Displacement of the second trunnions 316 toward the rocker arms 320 pivots the rocker arms 320 to move the rollers 300 in tandem toward their retracted positions (as shown by arrows C in FIG. 5).

Displacement of the second trunnions 316 away from the rocker arms 320 pivots the rocker arms 320 to move the rollers 300 in tandem toward their extended positions.

Springs 324 normally urge the second trunnions 316 to pull against the rocker arms 320, thereby urging the rollers 300 toward their extended positions. The springs 324 yieldably resist movement of the rollers 300 toward their retracted positions.

Figure 7:
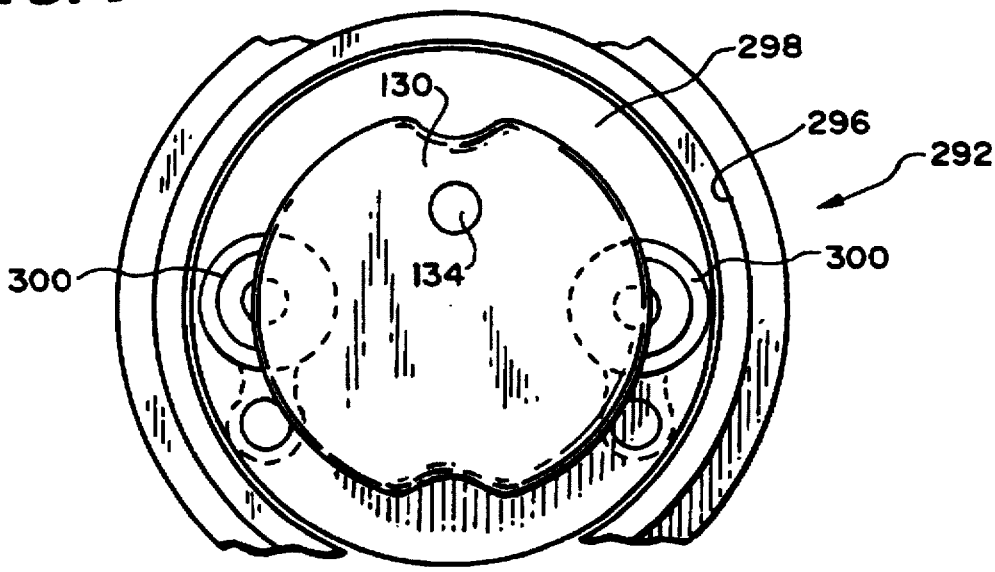
FIG. 7 is a top view of the rotor assembly with the pump rotors extended, as FIG. 6 shows.
Figure 9:
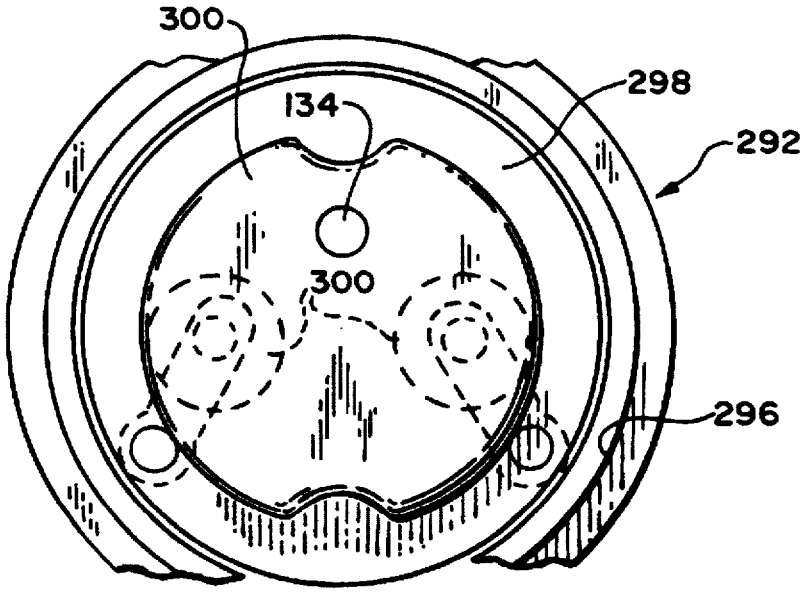
FIG. 9 is a top view of the rotor assembly with the pump rotors retracted, as FIG. 8 shows.

In this arrangement, inward sliding movement of the handle 130 toward the rotor 298 (as FIGS. 6 and 7 show) displaces the second trunnions 316, pivoting the rocker arms 320 to move the rollers 300 into their extended positions. Outward sliding movement of the handle 130 away from the rotor 298 (as FIGS. 4B, 8, and 9 show) returns the rollers 300 to their retracted positions, against the biasing force of the springs 324.

The independent action of each spring 324 against its associated second trunnion 316 and link 314 places tension upon each individual pump roller 300 to remain in its fully extended position. Each roller 300 thereby independently accommodates, within the compression limits of its associated spring 324, for variations in the geometry and dimensions of the particular tubing 120 it engages. The independent tensioning of each roller 300 also accommodates other mechanical variances that may exist within the pump 100, again within the compression limits of its associated spring 324.

In the illustrated and preferred embodiment, the roller locating assembly 306 further includes an actuating rod 308 that extends through a bore 146 along the axis of rotation of the rotor 298. As FIG. 1 best shows, the proximal end of the actuating rod 308 is coupled to a linear actuator 310. The actuator 310 advances the rod 308 fore and aft along the axis of rotation.

Figure 10:
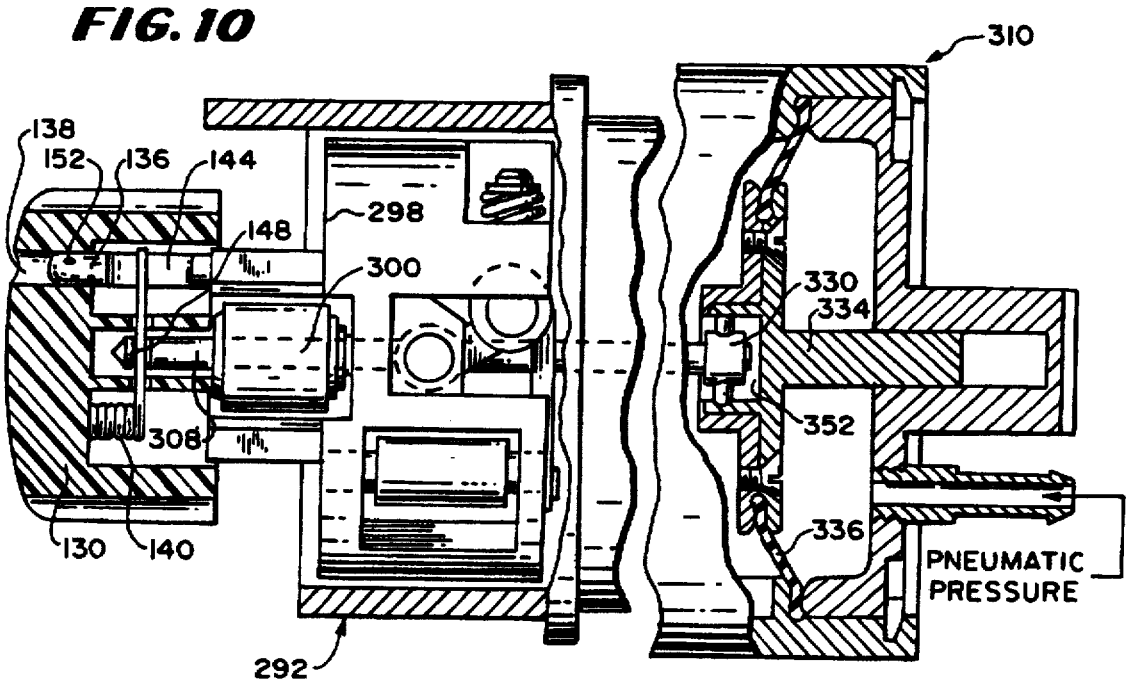
FIGS. 10 and 11 are side section views, with portions broken away, of a mechanism for automatically extending and retracting the pump rotors in the pump shown in FIG. 1A, FIG. 10 showing the rollers retracted and FIG. 1 1 showing the roller extended.
Figure 11:
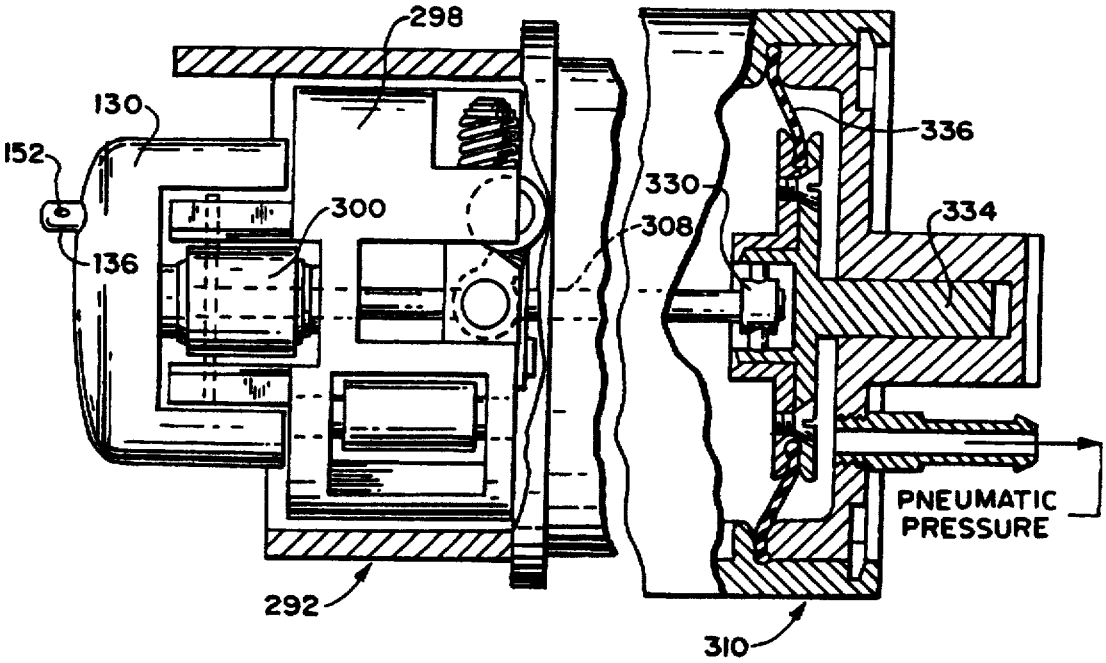
Figure 13:
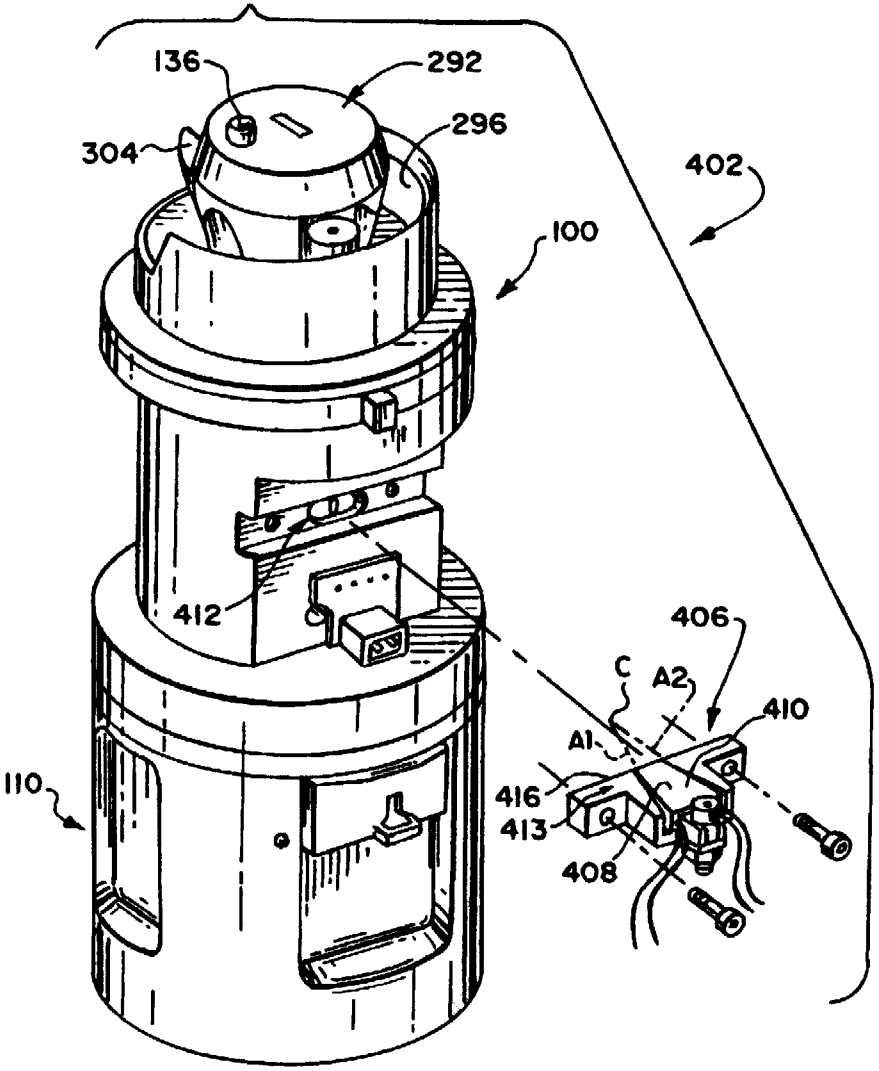
FIG. 13 is a perspective rear view of the pump shown in FIG. 12, showing in an exploded position the associated reflective object sensor for sensing the position of the rotor assembly when oriented for loading pump tubing.

As FIG. 1 also best shows, the distal end of the rod 308 extends into the center shaft 132 of the gripping handle 130. The distal end of the rod 308 includes a groove 148 that aligns with the handle shaft groove 142, so that the release spring 140 engages both grooves 142 and 148 when its free end rests against the relieved surface 144 (see FIG. 1A). In this arrangement (as FIGS. 10 and 11 show), aft sliding movement of the actuator rod 308 slides the handle 130 inward toward the rotor 298, thereby moving the rollers 300 into their extended positions. Forward movement of the actuator rod 308 slides the handle 130 outward from the rotor 298, thereby returning the rollers 300 to their retracted positions against the force of the springs 324.

The back end of the rotating actuator rod 308 passes through a thrust bearing 330 (see FIG. 1A). The thrust bearing 330 has an outer race 352 attached to a shaft 334 that is an integral part of the linear actuator 310.

In the illustrated embodiment (see FIGS. 10 and 11), the linear actuator 310 is pneumatically operated, although the actuator 310 can be actuated in other ways. In this arrangement, the actuator shaft 334 is carried by a diaphragm 336. The shaft 334 slides the handle outward (as FIG. 10 shows) in response to the application of positive pneumatic pressure from a pneumatic controller 326 (see FIG. 1), thereby retracting the rollers 300. The shaft 334 slides the handle inward (as FIG. 11 shows) in response to negative pneumatic pressure from the controller 326, thereby extending the rollers 300.

In the embodiment illustrated in FIG. 1A), the actuator shaft 334 carries a small magnet 338. The actuator 310 carries a hall effect transducer 340. The transducer 340 senses the proximity of the magnet 338 to determine whether the shaft 334 is positioned to retract or extend the rollers 300. The transducer 340 provides an output to an external controller as part of its overall monitoring function. Other alternative mechanisms can be used to sense the position of the shaft 334, as will be described in greater detail later.

Selectively retracting and extending the rollers 300 serves to facilitate loading and removal of the tubing 120 within the race 296. Selectively retracting and extending the rollers 300 when the rotor 298 is held stationary also serves a valving function to open and close the liquid path through the tubing 120. Further details of the features are set forth in copending application Ser. No. 08/175,204, filed Dec. 22, 1993 and entitled "Peristaltic Pump with Linear Pump Roller Positioning Mechanism", and copending application Ser. No. 08/172,130, filed Dec. 22, 1993, and entitled "Self Loading Peristaltic Pump Tube Cassette."

Figure 12:
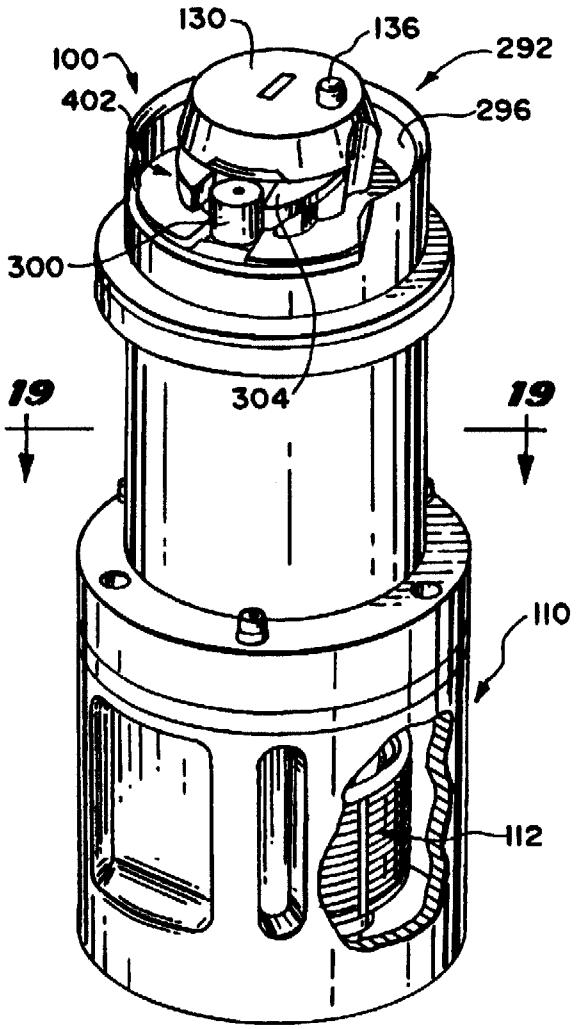
FIG. 12 is a perspective front view of the pump shown in FIG. 1A, with a portion broken away.

In a preferred embodiment (see FIG. 12), the pump 100 just described measures about 2.7 inches in diameter and about 6.5 inches in overall length, including the drive train assembly 110 and the pump rotor assembly 292.

Figure 14:
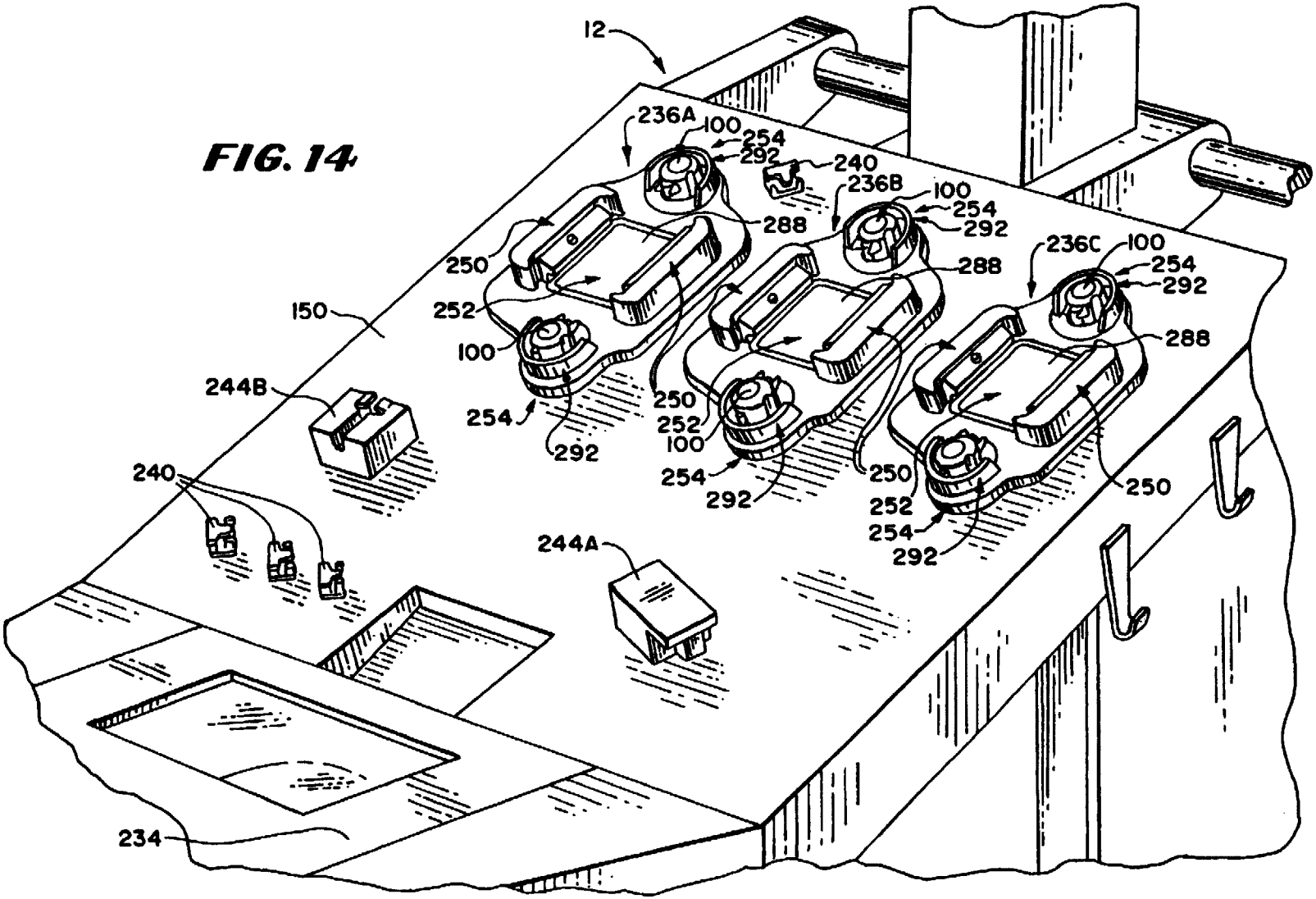
FIG. 14 is a perspective view of several pumps shown in FIG. 1A in associated with a centrifuge apparatus.

In use (as FIG. 14 shows), one or more pumps 100 are mounted on a work surface 150, with the pump rotor assembly 292 exposed outside the work surface 150 and the drive train assembly 110 extending within the work surface 150. The particular arrangement of the pumps 100 shown in FIG. 14 is part of a centrifugal blood processing device 12 fully described in Chapman et U.S. patent application Ser. No. 08/173,518, filed Dec. 22, 1993, entitled "Peristaltic Pump Tube Cassette With Angle Pump Tube Ports," which is incorporated herein by reference.

The centrifuge device 12 includes three pumping stations 236 A/B/C (see FIG. 14), located side by side on the work surface 150. The work surface 100 also carries shut-off clamps 240, hemolysis sensor 244A, and air detector 244B associated with the centrifuge device 12.

Figure 15:
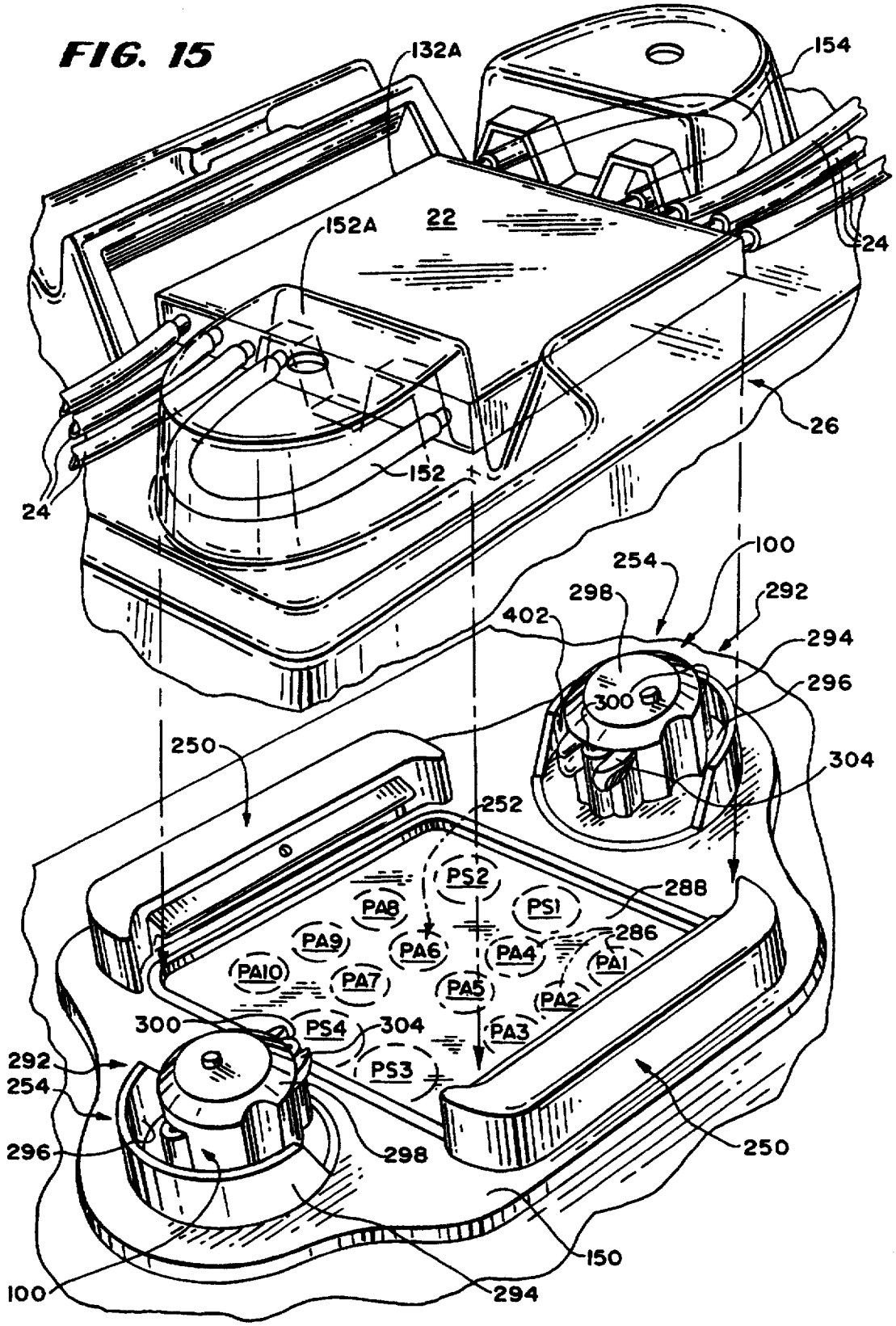
FIG. 15 is a perspective view of a liquid flow cassette and pump station with which two pumps shown in FIG. 14 are associated.

Each control station 236A/B/C holds one fluid flow cassette 22 (see FIG. 15), which in the illustrated embodiment is carried within a tray 26. Each cassette 22 includes an array of liquid flow passages and valve stations connected to external tubing 24 to centralize the valving and pumping functions needed to carry out the selected procedure. Oppositely spaced, external tubing loops 152 and 154 (see FIG. 15) communicate with the interior fluid passages of each cassette 22. In use, the tubing loops 152 and 154 engage peristaltic pump rotor assemblies 292 of the pumps 100, as will be described further, to convey liquid into the cassette 22 and from the cassette 22.

Further details of the construction of the cassettes 22 and tray 26 are described in the above-identified Chapman et U.S. patent application Ser. No. 08/173,518, filed Dec. 22, 1993, entitled "Peristaltic Pump Tube Cassette With Angle Pump Tube Ports," which is incorporated herein by reference.

Each control station 236A/B/C (see FIGS. 14 and 15) includes a cassette holder 250. The holder 250 receives and grips the cassette 22 in the desired operating position on the control station 236A.

The holder 250 urges a flexible diaphragm (not shown) on one side of the cassette 22 into intimate contact with a valve module 252 on the control station 236A. The valve module 252 includes an array of solenoid plungers (designated PA 1 to PA 10) in FIG. 15) that open and close the valve stations in the cassette 22. The valve module 252 also includes an array of pressure sensors (designated PS1 to PS4 in FIG. 15) that sense liquid pressures within the cassette 22.

Each control station 236A/B/C also includes two peristaltic pump modules 254 (see, FIGS. 14 and 15), each comprising the pump 100 as already described. The rotor assemblies 292 of the pumps 100 face each other at opposite ends of the valve module 252.

Figure 16:
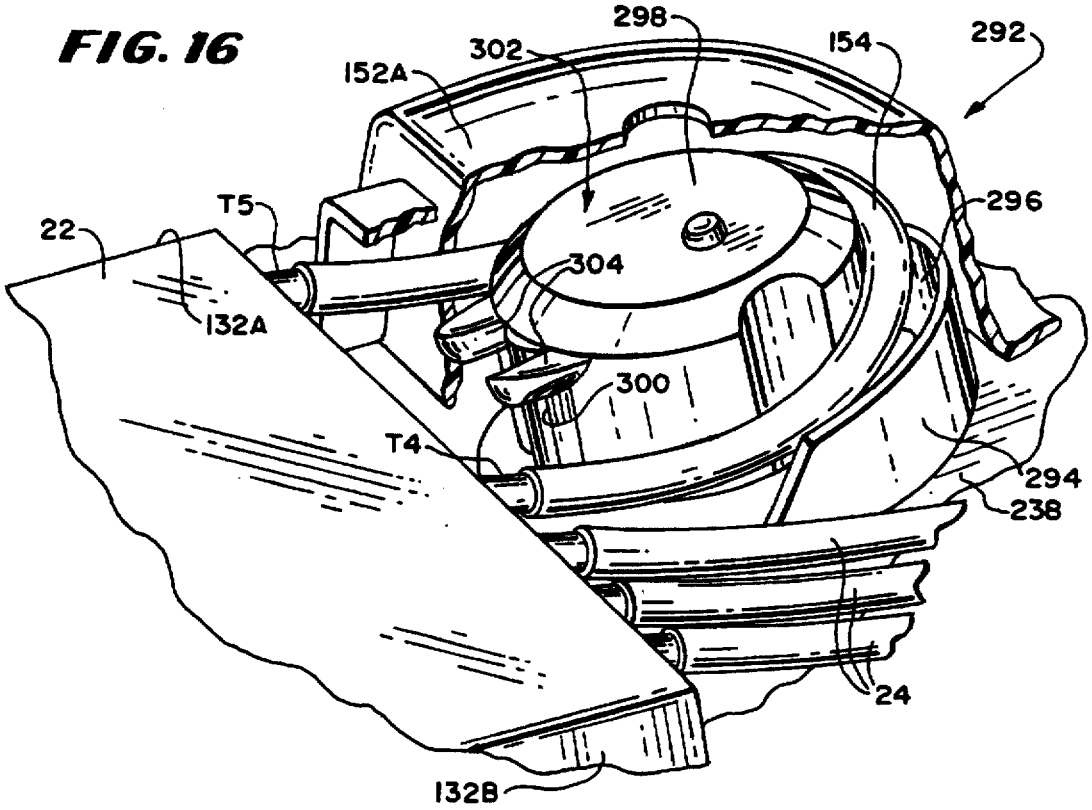
FIGS. 16; 17; and 18 are a sequence of perspective views showing the loading of the pump tubing on the liquid flow cassette shown in FIG. 15 in operative association with the pumps shown in FIG. 15.
Figure 17:
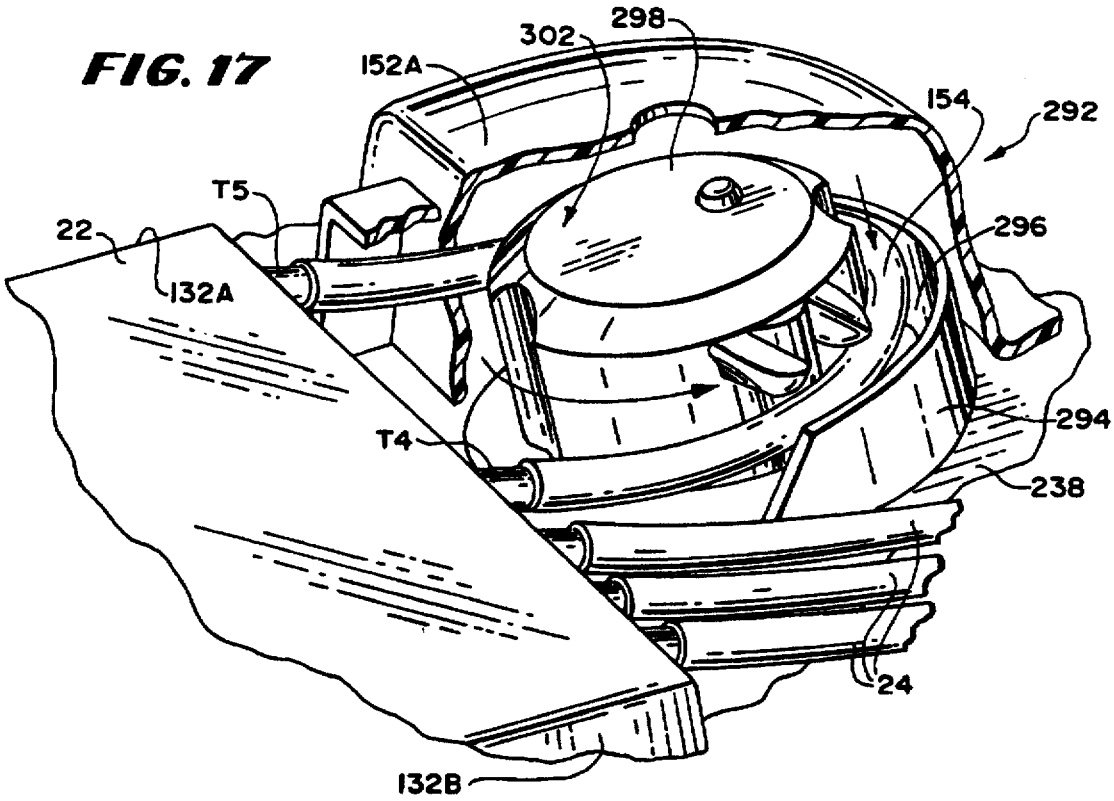

When the cassette 22 is gripped by the holder 250, the tubing loops 152 and 154 make operative engagement with the associated pump modules 254, with the tubing loops 152 and 154 extending into the associated pump race 296 (see FIG. 16). In use, as the pump rotor 298 rotates, the rollers 300 in succession compress the associated tubing loop 152/154 against the rear wall 294 of the pump race 296. This well known peristaltic pumping action urges fluid through the associated loop 152/154.

In the preferred embodiment shown in FIGS. 12 to 18, each rotor assembly 292 includes a self-loading mechanism 402. The self-loading mechanism 402 assures that the tubing loops 152/154 are properly oriented and aligned within their respective pump races 296 so that the desired peristaltic pumping action occurs.

While the specific structure of the self-loading mechanism 402 can vary, in the illustrated embodiment, it includes a pair of guide prongs 304 (see FIG. 16). The guide prongs 304 extend from the top of each rotor 298 along opposite sides of one of the pump rollers 300.

The loading mechanism 402 also includes a controller 246 (see FIG. 1A) operatively connected to the pneumatic controller 326, as already described, and the pump motor controller 328, which controls power to the pump motor 112. The controller 246, through the controller 326, sends command signals to actuate the actuator 310 to retract the rollers 300 before the cassette 22 is loaded onto the station 236A (as FIG. 16 shows). The controller 246 sends command signals through the pump motor controller 328 to position each rotor 298 to orient the guide prongs 304 to face the valve module 252, i.e., to face away from the associated pump race 296 (as FIG. 16 also shows).

With the guide prongs 304 positioned to face the valve module 252, the cassette 22 is loaded into the holder 250 with the tubing loops 152 and 154 each oriented with respect to its associated pump race 296. The guide prongs 304, being positioned away from the pump race 296, do not obstruct the loading procedure, as FIG. 16 shows. In the illustrated and preferred embodiment, the connectors T4/T5 to which the tubing loops 152 and 154 are attached are themselves angled toward the pump rotors 298 to better present the tubing loops 152/154 to the pump rotors 298 and to assure that the tubing loops 152/154 are slightly compressed within the races 296, when oriented perpendicular to the rotors 298 for use.

Subsequent rotation of the rotor 298 (see FIG. 17), as commanded by the controller 246 via pump motor controller 328, moves the guide prongs 304 into contact with the top surface of the tubing loops 152/154. This contact compresses the tubing loops 152/154 further into the pump race 296. This orients the plane of the tubing loops 152/154 perpendicular to the rotational axis of the rotor. Several revolutions of the rotor 298 will satisfactorily fit the tubing loop 152/154 into this desired orientation within the race 296. As already pointed out, the retracted rollers 300 serve no pumping function during this portion of the self-loading sequence.

Figure 18:
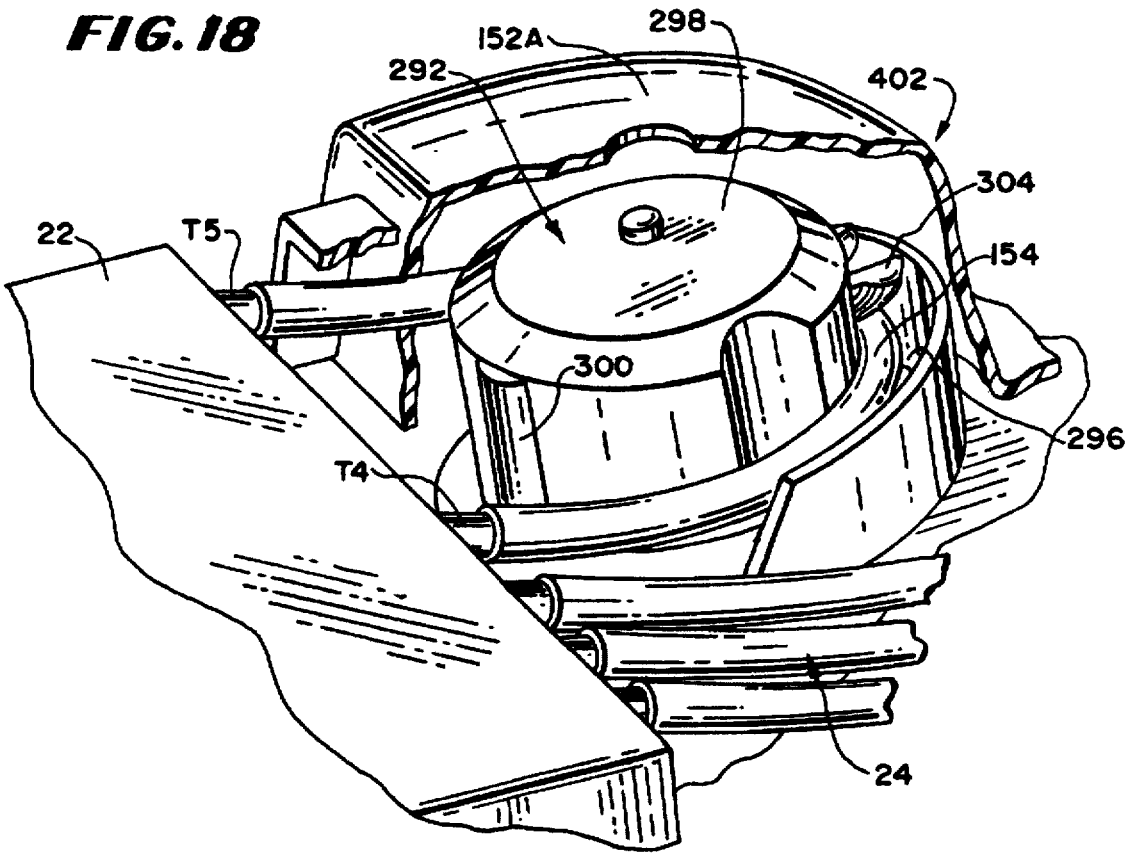

After a prescribed number of revolutions of the rotor 298, fitting the tubing loop 152/154 within the pump race 296, the controller 246 commands the pneumatic controller 326 to actuate the roller positioning actuator 310 and extend the rollers 300 (see FIG. 18). Subsequent rotation of the rotor 298 will squeeze the tubing loop 152/154 within the race 296 to pump liquids in the manner already described.

When it is time to remove the cassette 22, the controller 246 again commands the pneumatic controller 326 to retract the rollers 300. The controller 246 also commands the pump motor controller 328 to position the pump rotor 298 to again orient the guide prongs 304 to face away from the pump race 296 (as FIG. 16 shows). This opens the pump race 296 to easy removal of the tubing loop 152/154.

In the illustrated and preferred embodiment (see FIG. 13), the loading mechanism 402 includes a reflective object sensor 406 coupled to the controller 246. The sensor 406 comprises an infrared emitting diode 408 and an NPN silicon phototransistor 410 mounted side by side in a black plastic housing 413. The diode emitter 408 and phototransistor 410 having optical axes A1 and A2 which converge at point C, which is also called the point of optimal response. The phototransistor 410 responds to radiation from the emitter 408 when a reflective object passes within its field of view in the vicinity of the point C of optimal response.

An example of a representative sensor of this type that is commercially available is the OPTEK Type OPB700 and OPB700AL (available from Optek Technology, Inc., Carrollton, Tex.).

According to the invention, the reflective object sensor 406 is positioned so that its field of view faces a reflective surface that moves in synchrony with the rotor 298. In the illustrated embodiment (best shown in FIGS. 1A and 13), the drive train 110 includes a view disk 412 carried by the carrier shaft 126, to which the carrier 128 for the rotor 298 is connected (see FIG. 1B also). The view disk 412 and rotor 298 thus rotate in synchrony with the carrier shaft 126.

Figure 19:
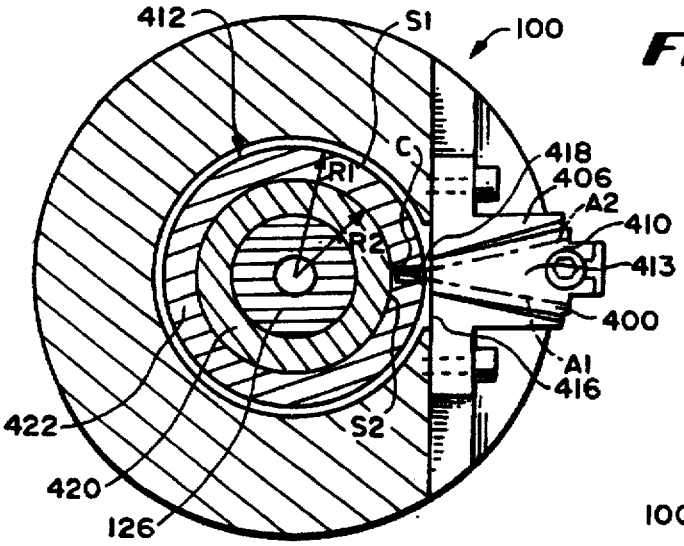
FIG. 19 is a section view, taken generally along line 19—19 in FIG. 12, showing the orientation of the reflective object sensor shown in FIG. 20 with the view disk, when the pump rotor assembly is located in position for receiving pump tubing.
Figure 20:
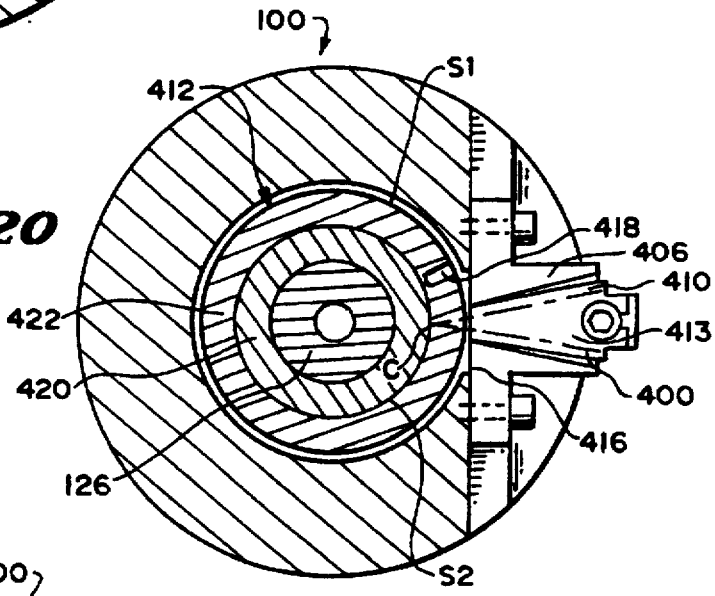
FIGS. 20 and 21 show the orientations of the reflective object sensor and view disk shown in FIG. 19, when the pump rotor assembly is located, respectively, in advance of and past the position for receiving pump tubing.
Figure 21:
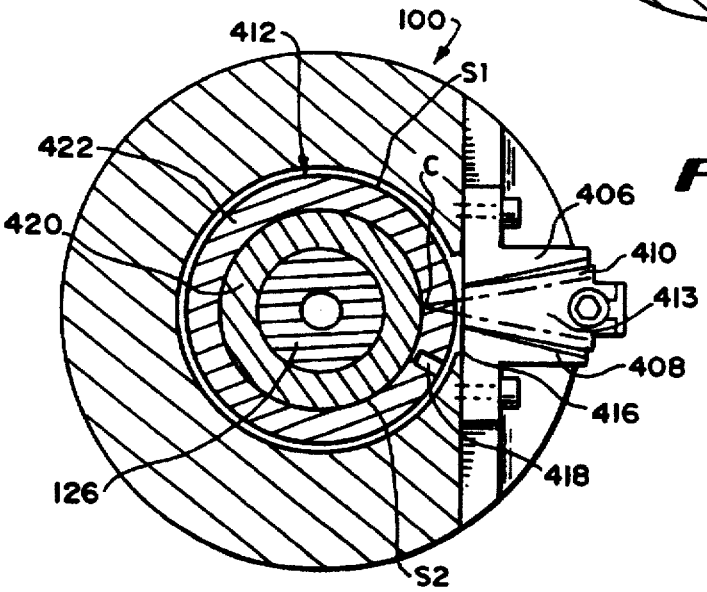

As FIGS. 19 to 21 best show, the periphery of the view disk 412 comprises first and second exposed surface portions, designated S1 and S2. The first exposed surface portion S1 is concentric with the carrier shaft 126 and spaced a first radial distance R1 from the axis of rotation (as FIG. 19 shows). The second surface portion S2 is also concentric with the carrier shaft 126, but is spaced a second radial distance R2 less than the first radial distance R1. The second exposed surface S2 must be reflective of the radiation of the emitter 408. The first exposed surface S1 can also be reflective of the radiation of the emitter 408, but it need not be.

As FIGS. 19 to 21 further show, the reflective object sensor 406 is positioned so that the first surface portion S1 lies significantly inside the point C of optimum response. On the other hand, the second surface portion S2 is arranged to lie near the point C.

The view disk 412 is oriented on the carrier shaft 126 so that the second surface portion S2 is exposed to the view field of the object sensor 406 (as FIG. 20 shows) only when the rotor 298 is rotationally positioned to orient the guide prongs 304 facing the valve module 252, i.e., to face away from the associated pump race 296, as FIG. 16 shows. As before explained, this is the position that affords best access to the rotor 298 for loading the associated tubing loop 152/154.

To differentiate this position from the other rotational positions of the rotor 298, the arc of exposure for second surface portion S2 extends only a relatively short circumferential distance on the periphery of the view disk 412, with its midpoint aligning with the exact rotational position desired for the rotor 298. It in effect constitutes a recess 418. When the rotor 298 is outside this desired rotational position, only the first surface portion S1 is exposed within the viewing field of the object sensor (as FIGS. 19 and 21 show).

As the first surface portion S1 of the view disk 412 rotates past the object sensor 406 (as FIGS. 10 and 21 show), the phototransistor 410 will sense no or only a minimal amount of radiation reflected by the surface S1 from the emitter 408. This is because the surface S1 lies well inside the point C of optimum response. As a result, there will be no or only a minimal amount of voltage output from the phototransistor 410.

When the second surface S2 of the view disk 412 (i.e., recess 418) rotates past the object sensor 406, the phototransistor 410 will sense a significant increase in the amount of radiation reflected by the surface S2 from the emitter 408. This is because the surface S2 lies close to or on the point C of optimum response. As a result, there will be a significant increase in the voltage output of the phototransistor 410, which the controller 246 will sense. The increase in voltage output will persist as long as the object sensor 406 views the second surface S2, i.e., as long as the recess 418 remains in the viewing field. Because the arcuate exposed length of the second surface S2 (i.e., recess 418) is relatively small, the increase in voltage will be pronounced and easily detected by the controller 246.

In a representative implementation, an OPTEK OPB700 series sensor as above described has a point of optimum response that is rated in its product bulletin as 0.125 inch from the transmitting/viewing edge 416 of the sensor 406 (see FIGS. 13 and 19 to 21). In this arrangement, the periphery of the first surface S1 of the view disk 412 has an outer radius R1 of 0.586 inches from the rotational axis of the carrier shaft 126. The distance between the first surface S1 and the transmitting/viewing edge 416 of the sensor 406 (measured radially of the axis of rotation) is 0.007 inch. The periphery of the second surface S2 has an outside radius R2 of 0.500 inch from the rotational axis of the carrier shaft 126. This provides a radial depth for the recess 418 of 0.086 inch, measured between the first and second surface portions S1 and S2. The provides a total distance between the transmitting/viewing edge 416 of the sensor and the second surface portion S2 within the recess 418 (measured radially of the axis of rotation) of 0.093 inch. It is believed that the above dimensions can be altered to provide a range of distances between the transmitting/viewing edge 416 of the sensor 406 and the second surface S2 within the recess 418 (measured radially of the axis of rotation) of between about 0.060 inch and about 0.180 inch, spanning either side of the 0.125 inch point of optimum response. The width of exposure of the recess 418 is 0.093 inch.

In this arrangement, the viewing disk 412 can comprise a structurally separate inner stainless steel disk 420 (see FIGS. 19 to 21), whose outer periphery comprises the second surface portion S2, and a structurally separate outer concentric disk 422 (see FIG. 1A too) made of gold coated aluminum pressed on the inner disk 420. The outer periphery of the outer disk 422 comprises the first surface portion S1. The recess 418 is formed by a through-slot formed in the outer disk 422, exposing a portion of the inner disk periphery.

Figure 22:
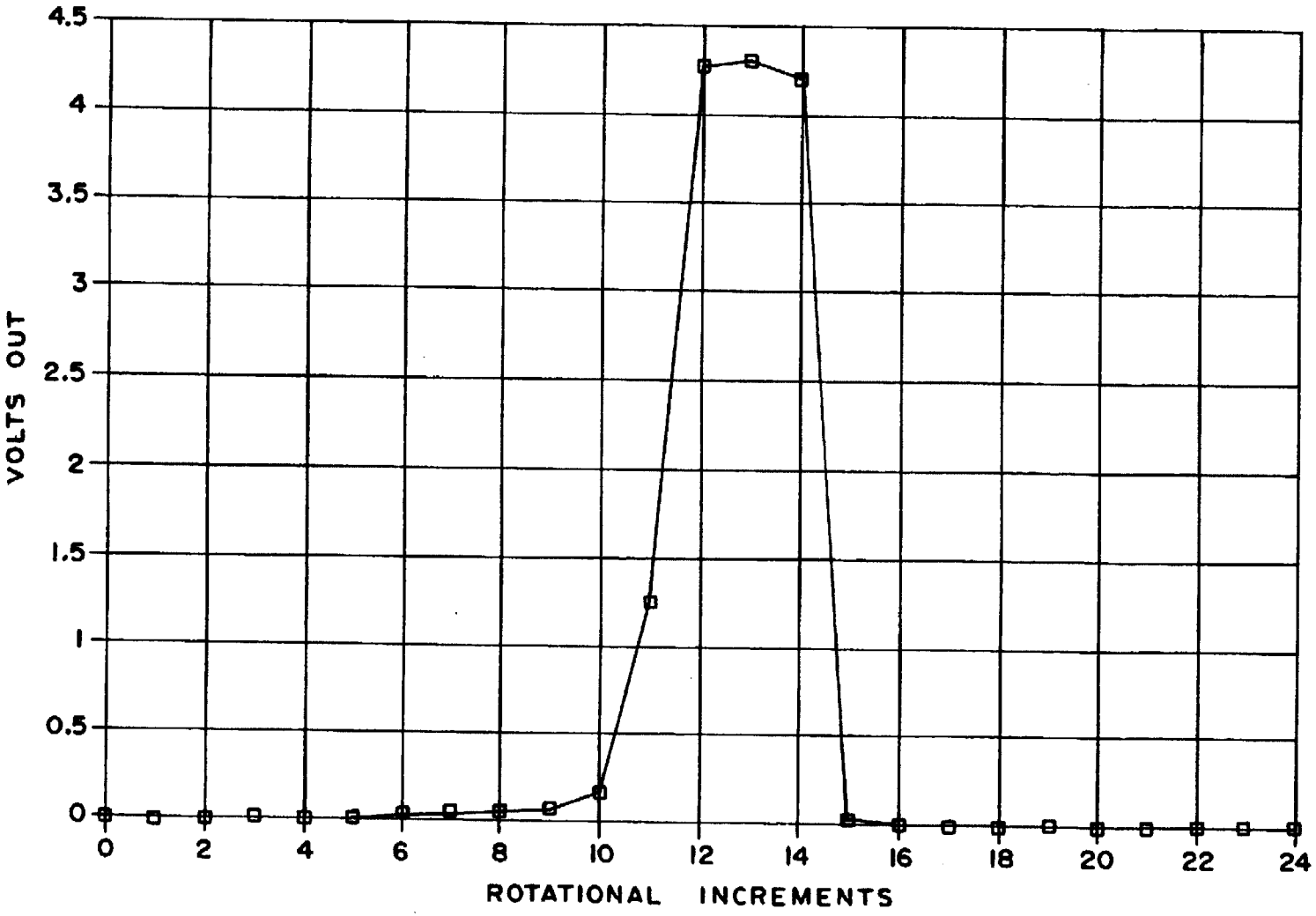
FIG. 22 is a graph showing the sensitivity of the reflective object sensor to the viewing disk shown in FIGS. 19 to 21.

FIG. 22 graphically shows the sensitivity of an object sensor 406 arranged as described above to the rotation of the viewing disk 412 having the dimensions described above. Each rotational increment constitutes 1.3° degrees of rotation. FIG. 22 shows a very low voltage output for the first nine rotational increments (11.7°), during which time the first surface portion S1 passes by the object sensor 406 (as FIG. 19 generally shows). Beginning with the tenth rotational increment and ending with the fourteenth rotational increment (6.5°), FIG. 22 shows a progressive, significant increase in the voltage output, during which time the recess 418 exposing the second surface portion S2, passes by the object sensor 406 (as FIG. 20 generally shows). The voltage output drops again to its previously low, marginal level starting with the fifteen rotational increment, as the recess 418 passes and the first surface portion S1 is again viewed by the object sensor (as FIG. 21 generally shows).

It is during the 6.5° increment when high voltage output occurs (see FIGS. 20 and 22) that the rotor 298 is rotationally positioned to orient the guide prongs 304 to face away from the associated pump race 296 (as FIG. 16 shows) affording the best access to the rotor 298 for loading the associated tubing loop 152/154.

Upon sensing the significant increase in voltage output from the sensor 406, the controller 246 commands the pump rotor 296 (via the motor controller 328) to stop rotation, locating it for loading of the tubing loop 152/154. The controller 246 also commands the pneumatic controller 326 to operate the pump roller actuator 310.

Various features of the invention are set forth in the following claims.

I claim:

1. A peristaltic pumping mechanism comprising a peristaltic pumping element including a pump rotor carrying a roller, a drive motor, a drive shaft coupling the drive motor to the pump rotor to rotate the pump rotor about a rotational axis in a range of rotational positions including a load position, in which the pump rotor is presented to receive pump tubing, linkage coupled to the roller to move the roller between a retracted position free of contact with pump tubing and an extended position making operative contact with pump tubing, a reflective object sensor that transmits energy along a first optical axis and senses reflected energy along a second optical axis, the first and second axes converging at an optical focus, the reflective object sensor generating an output that varies according to magnitude of the reflected energy, a first disk carried by the drive shaft for rotation in synchrony with the pump rotor through the range of rotational positions, the first disk having an exterior surface made of a material that reflects energy transmitted by the reflective object sensor, the exterior surface being spaced in optical alignment with the reflective object sensor at or near the optical focus, a second disk carried by the drive shaft concentrically about the first disk for common rotation in synchrony with the pump rotor, the second disk being spaced inside the optical focus of the reflective object sensor, the second disk covering the exterior surface of the first disk, except for a slotted region, through which the exterior surface of the first disk is exposed, the slotted region being in optical aligned with the reflective object sensor only when the pump rotor is in the load position, the reflective object sensor generating, during rotation of the pump rotor through the range of rotational position, a first output while the slotted region is in optical alignment with the reflective object sensor and a second output different than the first output while the slotted region is out of optical alignment with the reflective object sensor, and a controller coupled to the reflective object sensor, the drive motor, and the linkage operative in response to the first output to command the drive motor to cease rotation of the pump rotor and to command the linkage to move the roller to the retracted position.

2. A pumping mechanism according to claim 1 wherein the slotted region represents an arc of less than about 10° of rotation of the pump rotor.

3. A pumping mechanism according to claim 1 wherein the peristaltic pumping element includes a pump race, wherein the range of rotational positions includes a range of operating positions in which the roller is in operative alignment with the pump race, and wherein, when the pump rotor is in the load position, the roller is out of operative alignment with the pump race.

4. A peristaltic pumping mechanism comprising a peristaltic pumping element including a pump rotor carrying a roller, a drive motor, a drive shaft coupling the drive motor to the pump rotor to rotate the pump rotor about a rotational axis in a range of rotational positions, one of the positions comprising a load position in which the pump rotor is presented to receive pump tubing, linkage coupled to the roller to move the roller between a retracted position free of contact with pump tubing and an extended position making operative contact with pump tubing, a reflective object sensor that transmits energy along a first optical axis and senses reflected energy along a second optical axis, the first and second axes converging at an optical axis, the reflective object sensor generating an output that varies according to magnitude of the reflected energy, a view disk carried by the drive shaft for rotation in synchrony with the pump rotor, the view disk having a first surface made of a material that reflects energy transmitted by the reflective object sensor and oriented in optical alignment with the reflective object sensor at or near the optical focus only when the pump rotor is in the load position, the view disk including a second surface oriented in optical alignment with the reflective object sensor when the pump rotor is outside the load position, the second surface being spaced from the optical focus, the reflective object sensor generating, during rotation of the pump rotor, a first output while the first surface is in optical alignment with the reflective object sensor and a second output different than the first output while the first surface is out of optical alignment with the reflective object sensor, and a controller coupled to the reflective object sensor, the drive motor, and the linkage operative in response to the first output to command the drive motor to cease rotation of the pump rotor and to command the linkage to move the roller to the retracted position.

5. A pumping mechanism according to claim 4 wherein the first surface represents an arc of less than about 10° of rotation of the pump rotor.

6. A pumping mechanism according to claim 4 wherein the peristaltic pumping element includes a pump race, wherein the range of rotational positions includes a range of operating positions in which the roller is in operative alignment with the pump race, and wherein, when the pump rotor is in the load position, the roller is out of operative alignment with the pump race.

* * * * *

UNITED STATES PATENT AND TRADEMARK OFFICE

CERTIFICATE OF CORRECTION

PATENT NO. : 5,711,654
DATED : January 27, 1998
INVENTOR(S) : Afflerbaugh

It is certified that error appears in the above-identified patent and that said Letters Patent is hereby corrected as shown below:

Column 6,
Line 44, after “Chapman et” insert -- al --

Column 10,
Line 26, before “linkage” insert -- a --
Line 51, delete “aligned” and substitute -- alignment --

Column 11,
Line 18, before “linkage” insert -- a --

Signed and Sealed this

Fifteenth Day of June, 2004

JON W. DUDAS
*Acting Director of the United States Patent and Trademark Office*